US010228218B2

(12) United States Patent
Mason et al.

(10) Patent No.: US 10,228,218 B2
(45) Date of Patent: Mar. 12, 2019

(54) BOW SIGHT

(71) Applicant: Gregory E. Summers, Madison Heights, VA (US)

(72) Inventors: Tristan Mason, Madison Heights, VA (US); Gregory E. Summers, Amherst, VA (US)

(73) Assignee: Gregory E. Summers, Madison Heights, VA (US)

( * ) Notice: Subject to any disclaimer, the term of this patent is extended or adjusted under 35 U.S.C. 154(b) by 100 days.

(21) Appl. No.: 15/615,039

(22) Filed: Jun. 6, 2017

(65) Prior Publication Data

US 2018/0347947 A1 Dec. 6, 2018

(51) Int. Cl.
*F41G 1/467* (2006.01)

(52) U.S. Cl.
CPC ..... *F41G 1/467* (2013.01)

(58) Field of Classification Search
CPC ..... F41G 1/467
USPC ..... 33/265
See application file for complete search history.

(56) References Cited

U.S. PATENT DOCUMENTS 3,365,800 A * 1/1968 Carella ..... F41G 1/467 33/265
4,567,668 A * 2/1986 King ..... F41G 1/467 33/265
6,000,141 A * 12/1999 Afshari ..... F41G 1/467 33/265
6,443,142 B1 * 9/2002 Wiseby ..... F41G 1/467 124/87
6,904,688 B1 * 6/2005 Henry ..... F41G 1/467 124/87
2004/0111900 A1 * 6/2004 Rager ..... F41G 1/467 33/265
2011/0277329 A1 * 11/2011 Summers ..... F41G 1/467 33/265
2012/0186089 A1 * 7/2012 Willis ..... F41G 1/467 33/265
2013/0242593 A1 * 9/2013 LoRocco ..... F41G 1/345 362/551
2015/0135579 A1 * 5/2015 Summers ..... F41G 1/467 42/130
2017/0010069 A1 * 1/2017 Mason ..... F41G 1/467
2017/0030680 A1 * 2/2017 Heidemann ..... F41G 1/467
2017/0336171 A1 * 11/2017 Dale ..... F41G 1/44
2018/0045488 A1 * 2/2018 Hamm ..... F41G 1/38
2018/0216913 A1 * 8/2018 Schwartz ..... F41B 5/1442

* cited by examiner

*Primary Examiner* — G. Bradley Bennett
(74) *Attorney, Agent, or Firm* — Leading Edge Law Group, PLC

(57) ABSTRACT

A bow sight for recurve and compound bows includes a cylindrical housing, an exterior sight pin, and a rheostat cover to control the illumination of the sight pin. The sight pin is part of a ring pin assembly that mates with one end of the housing. An optical fiber is mounted on the external surface of the ring pin assembly and connected with the sight pin to illuminate the pin. The cover rotates about the housing and includes a portion that extends over the ring pin assembly to control the exposure of the optical fiber to ambient light to thereby control the intensity of illumination of the pin.

14 Claims, 7 Drawing Sheets

BOW SIGHT

BACKGROUND OF THE INVENTION

The present invention relates to a bow sight, and particularly to a recurve bow sight which provides superior accuracy.

Recurve bow sights used in target competition must conform with rules established by the World Archery Federation, previously FITA. These rules provide certain restrictions on sight point and particularly fiber optic sight pins.

A known recurve bow sight is the Flex Recurve Scope manufactured by Shrewd Archery. This scope includes a sight pin arranged within the tunnel or housing of the scope in compliance with FITA rules. One drawback of such prior bow sights is that it is not possible to control the degree of illumination of the sight pin, which is a particular problem in environments where there is an abundance of ambient light. In such situations, the sight produces a starburst effect which diminishes rather than enhances accuracy. In addition, due to the current FITA rule that limits the directional line-of-sight fiber length to just 20 mm (0.7874 in) maximum, the reduced amount of ambient light collected in the short length of fiber results in a dimly lit fiber optic sight pin.

The bow sight of the present disclosure was developed to overcome these and other drawbacks of conventional recurve bow sights by providing improved ring pin assemblies that feature longer fiber length to collect a greater amount of ambient light in low light situations, an adjustable partial cover to reduce the amount of ambient light collected in the fiber during full sunlight situations to eliminate the starburst effect, and the ring pin assemblies of varied fiber diameter size and color are exchangeable to accommodate the needs of an archer.

SUMMARY OF THE INVENTION

The present disclosure relates to a bow sight including a cylindrical housing having a threaded outer surface at a first end and a threaded inner surface at the other end. A ring pin assembly is mounted externally on the first end of the housing and is held in place by a ring pin retainer which is threaded on the external threads of the housing. The ring pin assembly includes a sight pin which is visible within the interior of the cylindrical housing. An optical fiber is mounted on the outer surface of the ring pin assembly and is connected with the sight pin to illuminate it with ambient light. A lens is arranged within the other end of the housing and held in place by a lens retainer connected with the housing via the internal threads on the housing other end.

The housing first end contains at least one slot which extends parallel to the axis of the housing. The ring pin assembly includes a projection configured to mate with the slot so that when the ring pin assembly is mounted on the housing, the projection fits within the slot to prevent the ring pin assembly from rotating relative to the housing.

The housing preferably includes a pair of slots arranged opposite one another in the first end. Thus, the housing may be reversed while still accommodating the ring pin assembly so that the sight is suitable for use by both right and left handed archers merely by reversing the housing.

According to an embodiment of the sight, an annular cover assembly is rotatably mounted on the housing outer surface. The cover assembly includes an arcuate portion which extends over at least a portion of the ring pin assembly to at least partially cover the optical fiber. Rotation of the cover assembly controls the amount of fiber which is exposed to ambient light, thereby controlling the brightness of the sight pin.

According to another embodiment of the sight, a level assembly is also mounted on the housing. The level assembly includes an annular ring arranged between the ring pin assembly and the ring pin retainer and a bubble-type level indicating device. The annular ring also includes a projection which is configured to mate with the slot in the housing first end.

In another embodiment of the sight, the level assembly annular ring includes a peep alignment ring which extends radially outwardly beyond the outer circumference of the housing. The peep alignment ring contains an annular surface which extends at least partially around the circumference of the ring. The annular surface is spaced from an inner portion of the level assembly to provide a visual perspective to the archer for superior accuracy when aiming the bow at a target.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
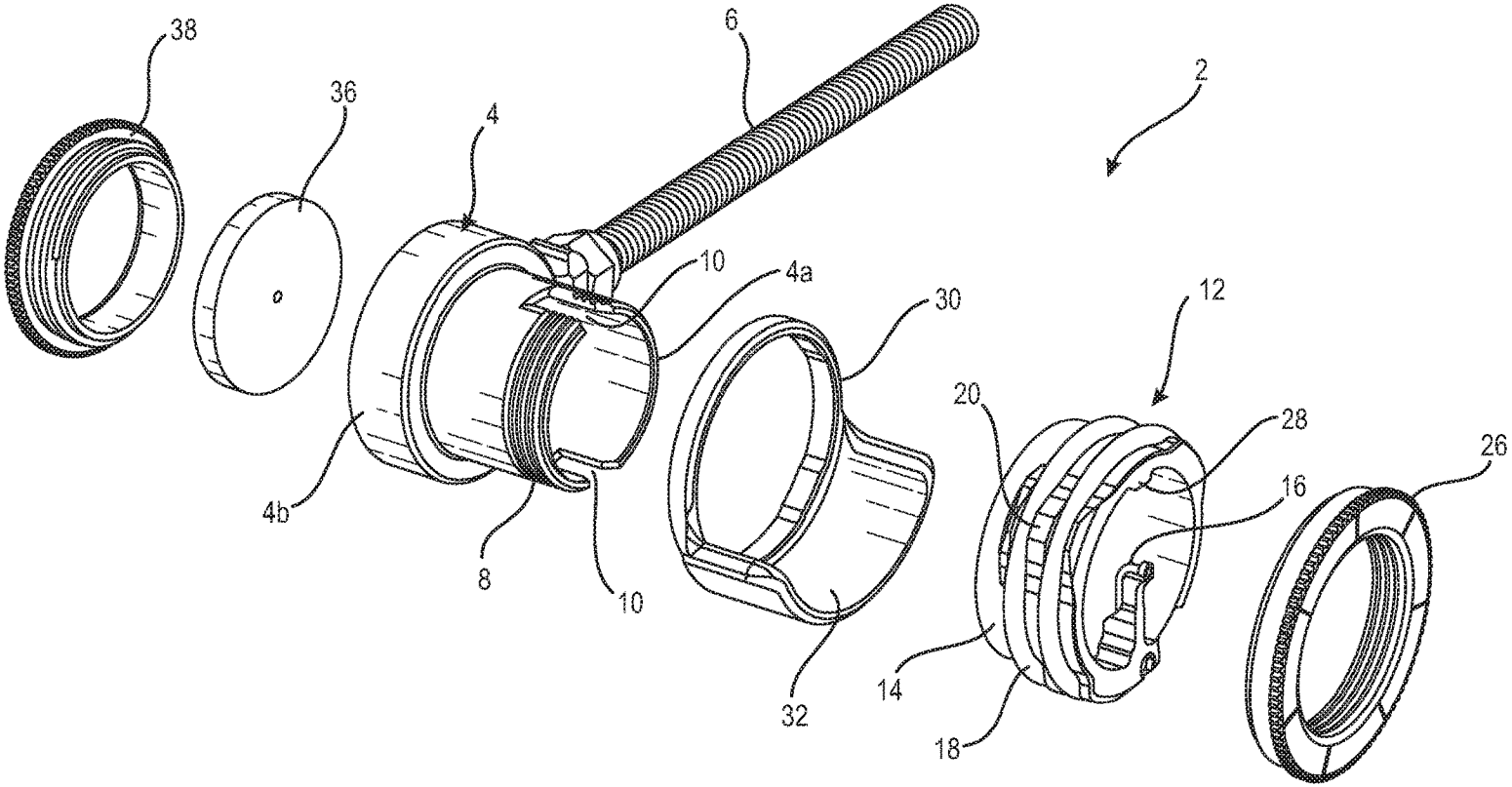
FIG. 1 is an exploded perspective view of a recurve bow sight according to the disclosure.
Figure 3:
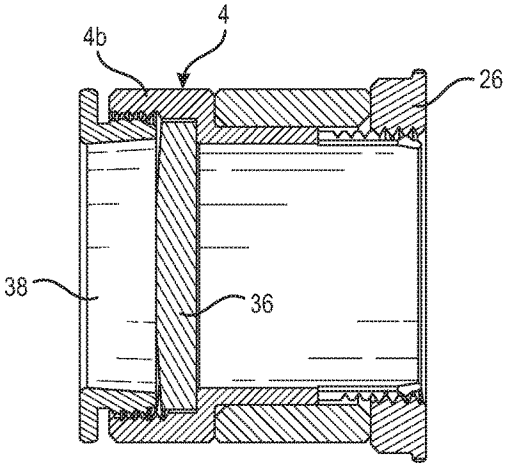
FIG. 3 is a sectional view of the bow sight of FIG. 2, but excluding the ring pin.
Figure 2:
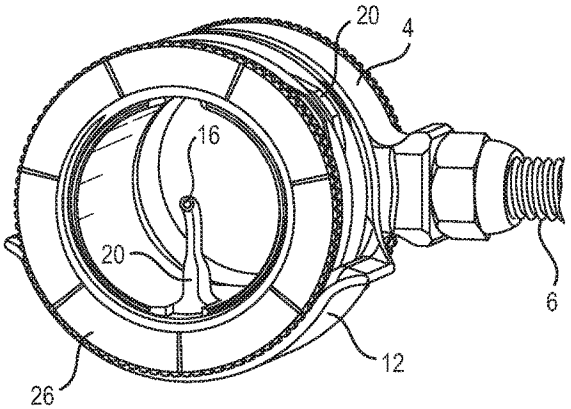
FIG. 2 is a perspective view of the bow sight of FIG. 1 in an assembled condition.
Figure 4:
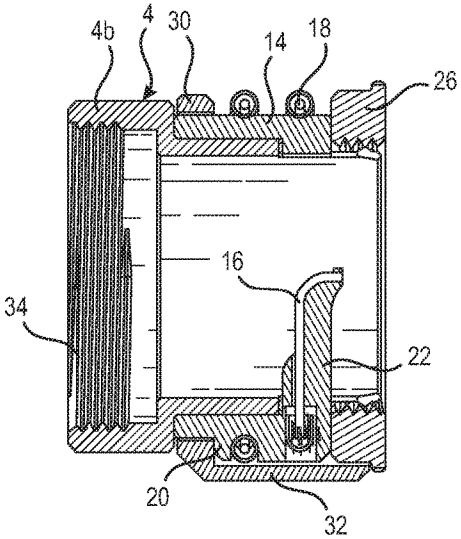
FIG. 4 is a sectional view of the housing, ring pin assembly, ring pin retainer, and cover assembly of the bow sight of FIG. 2.
Figure 5:
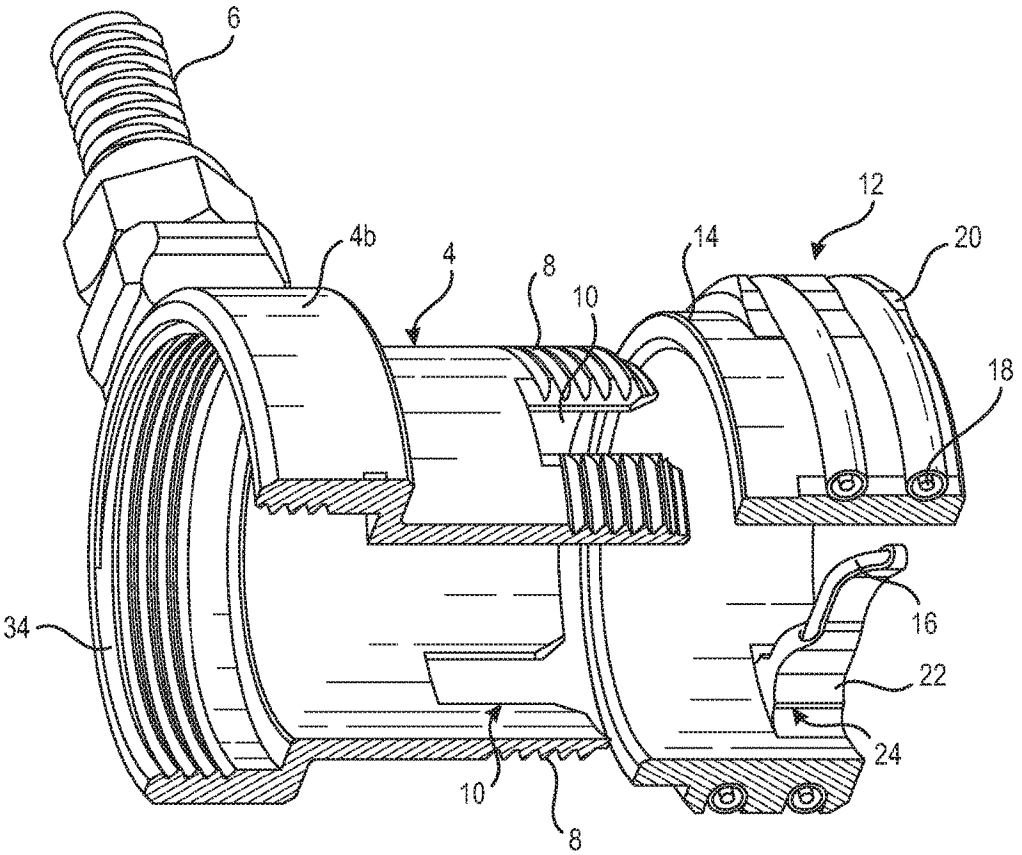
FIG. 5 is an exploded partial sectional view of the housing and ring pin assembly of the bow sight of FIG. 2.

The recurve bow sight 2 according to a first embodiment will be described with reference to FIGS. 1-9. The sight includes a generally cylindrical housing 4 having a longitudinal axis and a hollow interior. A threaded rod 6 is connected with a side portion of the housing in a known manner and is used to connect the sight with a bow, and preferably a recurve bow, not shown. A first end 4*a* of the housing has threads 8 on the external surface thereof. The first end further contains at least one slot 10 extending from the end of the housing and generally parallel to the housing axis. Preferably, two slots 10 are provided in the housing first end. As shown in FIGS. 1 and 5, the slots are preferably arranged opposite one another. In another embodiment, four slots are provided which are equally spaced around the housing first end with the slots being arranged in opposed pairs. This allows the sight pin to be mounted vertically or horizontally from four different directions, i.e. vertically bottom-to-center, vertically top-to-center, horizontally right-to center and horizontally, left to center.

A ring pin assembly 12 is removably connected with the housing first end 4*a*. The ring pin assembly includes a generally cylindrical ring portion 14 and a sight pin 16 which extends radially inward from the ring portion. The end of the sight pin is preferably arranged coaxial with the axis of the sight housing so that the pin end is centered with respect to the interior of the housing. However, the pin is exterior of the housing. An optical fiber 18 is arranged on the outer surface of the ring portion of the ring pin assembly. The optical fiber preferably has a small diameter on the order of 0.010 inches. As shown in FIG. 4, the fiber is wrapped around the cylindrical ring portion 14. The outer surface of the ring portion includes fittings 20 containing grooves which receive the fiber in a conventional manner such as a snap-fit connection. Preferably, the fiber is wrapped in a serpentine configuration on the surface of the ring portion 14 to provide a longer length without wrapping the fiber completely around the cylindrical ring portion so that a greater amount of light can be absorbed by the fiber for transmission to the sight pin 16 to illuminate the end of the pin.

As shown more particularly in FIG. 5, the ring pin assembly 12 includes a support 22 for the sight pin 16. The base of the support includes a projection 24 which is configured to mate with one of the slots 10 of the housing 4. Thus, with the ring pin assembly mounted on the housing, the projection will fit within and be retained by the housing slot. This prevents the ring pin assembly from rotating relative to the housing. A ring pin retainer 26 is internally threaded and is connected with the threads 8 on the external surface of the housing to hold the ring pin assembly on the housing. It will be readily apparent that different ring pin assemblies may be substituted on the housing merely by unscrewing the ring pin retainer 26 from the housing, removing a first ring pin assembly and replacing the assembly with a different ring pin assembly. For example, the ring pin assemblies may be made with differently colored optical fibers or with fibers of different diameters.

Figure 6:
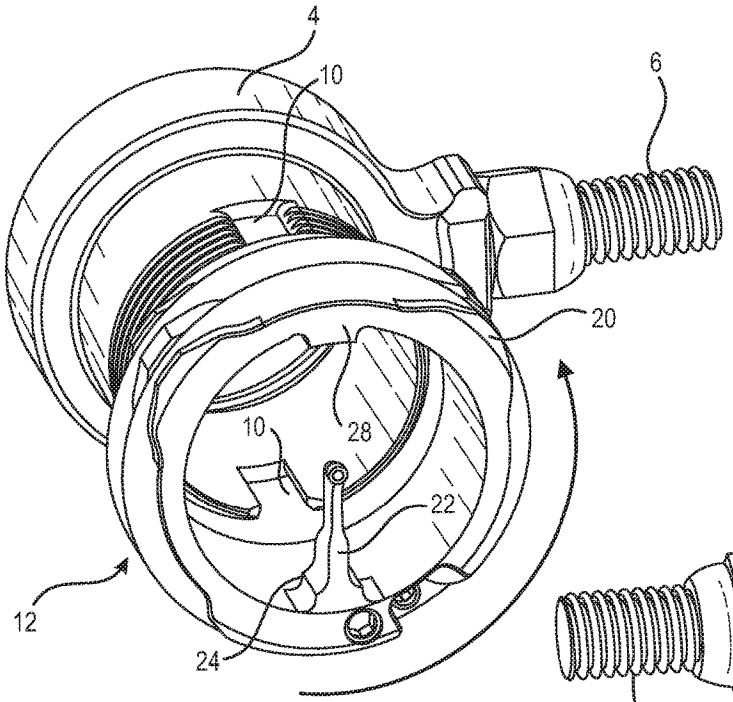
FIGS. 6 and 7 are exploded front perspective views of the reversible positions, respectively, of the housing of the bow sight of FIG. 2 for use by right and left handed archers.
Figure 7:
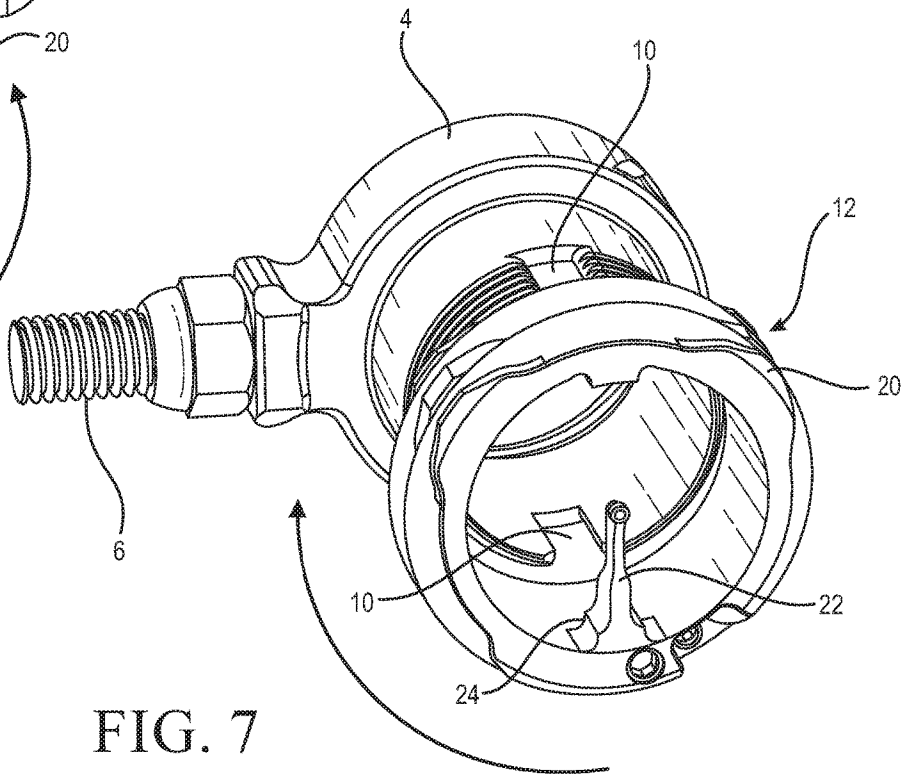

Referring to FIGS. 6 and 7, the bow sight according to the disclosure is ambidextrous in that it may be used by both right and left-handed archers. The ring pin assembly includes a second projection 28 opposite the projection 24 on the sight pin support 22. The second projection has the same configuration as the projection 24. Similarly, the slots 10 in the housing first end have the same configuration. When the ring pin retainer 26 and the ring pin assembly 12 are removed from the housing, the housing may be rotated 180° from the position shown in FIG. 6 to the position shown in FIG. 7. The ring pin assembly 12 and retainer 26 are mounted on and connected with the housing, respectively. Because the projections and slots have the same configuration, they can be alternated in positioning so that the sight can be configured for both right and left-handed archers.

Returning to FIG. 1, the bow sight preferably includes a cover assembly 30 which is mounted on the housing 4 for rotation through 360° about the housing outer surface. The cover assembly is configured as a ring and abuts against a second end portion 4*b* of the housing. The second end portion has a greater diameter than the first end portion 4*a* of the housing. The ring pin assembly 12 abuts against the other end of the cover assembly ring, but not so tightly as to prevent rotation of the ring relative to the housing. The cover assembly further includes an arcuate portion 32 extending generally halfway around the ring. The arcuate portion extends over the outer surface of the ring assembly as shown in FIG. 4.

Figure 8:
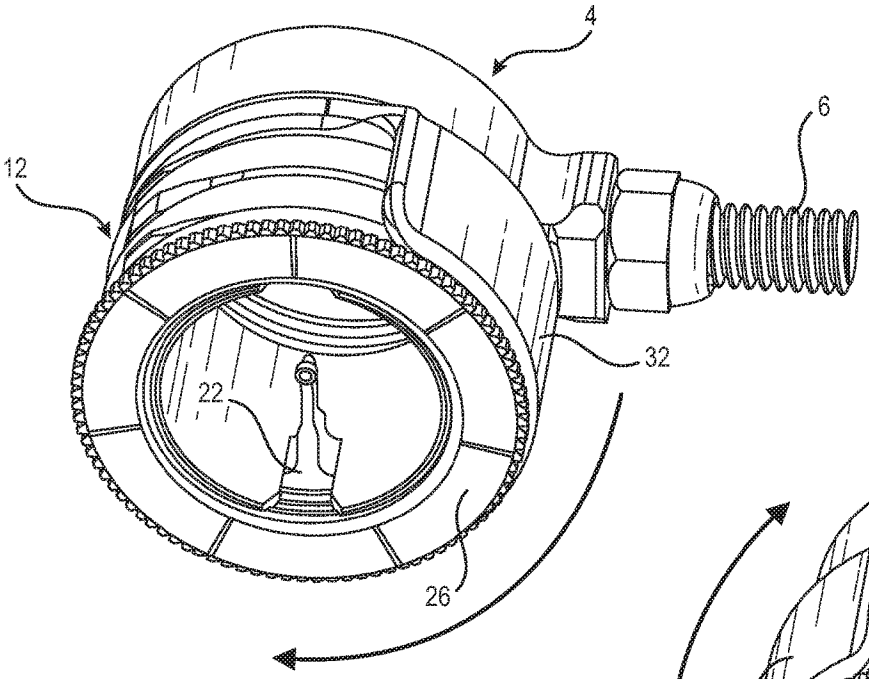
FIGS. 8 and 9 are top perspective views of the bow sight of FIG. 2 with the cover assembly rotated in different positions, respectively, relative to the housing.
Figure 9:
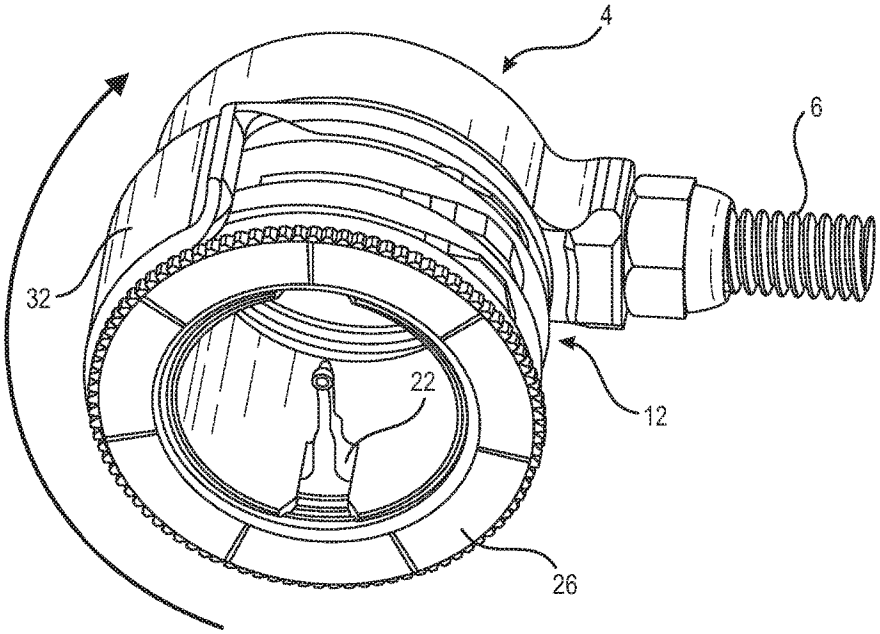

By rotating the cover assembly 30 around the housing as shown in FIGS. 8 and 9, a greater or lesser amount of the optical fiber on the surface of the ring pin assembly is exposed to ambient light. Thus, the rotating cover assembly operates as a rheostat to control the exposure of the optical fiber, thereby controlling the intensity of the illumination delivered to the end of the sight pin. This is particularly beneficial in that a starburst effect of the sight pin in bright conditions can be avoided by positioning the cover assembly to cover all or a portion of the optical fiber.

The end portion of the inner surface of the second end 4*b* of the housing contains threads 34 as shown in FIG. 4. As shown in FIGS. 1 and 3, a lens 36 is arranged within the housing second end 4*b* and retained therein by a lens retainer 38 which is threadably connected with the housing second end. Thus, the lens is also removable and replaceable.

Figure 10:
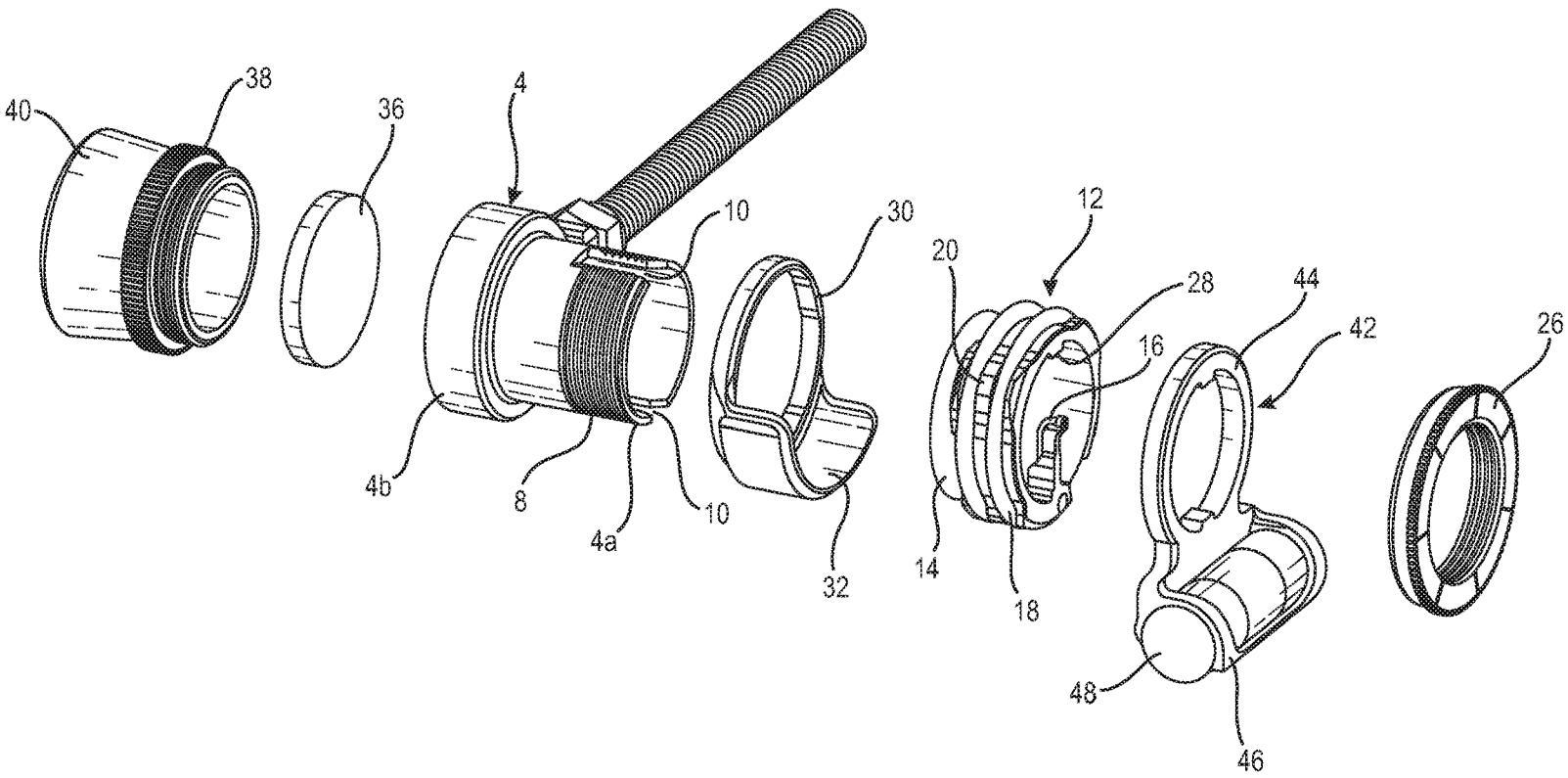
FIG. 10 is an exploded perspective view of a compound bow sight according to an alternate embodiment of the disclosure.

Referring now to FIG. 10, an alternate embodiment of the bow sight will be described. This embodiment is similar to the embodiment of FIGS. 1-9 except that it is a compound bow sight and includes a lens retainer 38 with a hood portion 40 and a level assembly 42. The level assembly includes an annular ring portion 44 and a receptacle 46 for retaining a bubble-type level indicator 48. The inner circumference of the ring portion 44 includes a pair of opposed projections 50 which are configured to mate with the slots 10 in the housing. The level assembly is arranged on the housing between the ring pin assembly 12 and the ring pin retainer 26, with the level assembly projections 50 arranged in the housing slots 10 so that the level assembly like the ring pin assembly is stationary relative to the housing.

Figure 11:
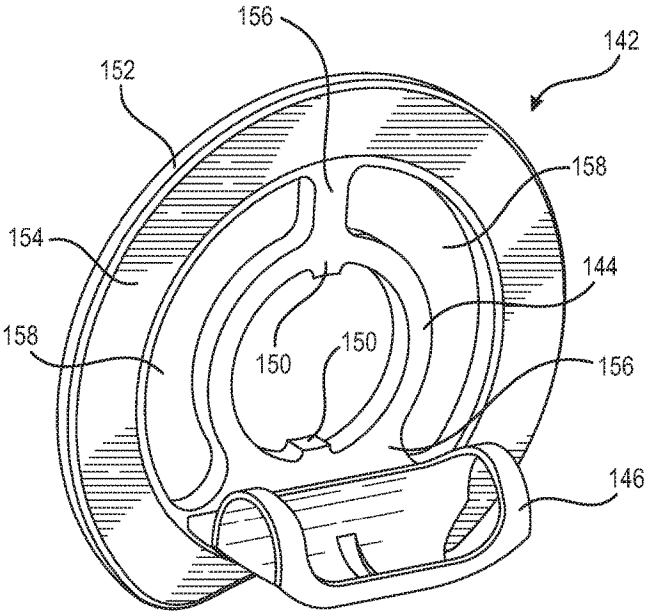
FIG. 11 is a front perspective view of a level assembly of the bow sight of FIG. 10.
Figure 12:
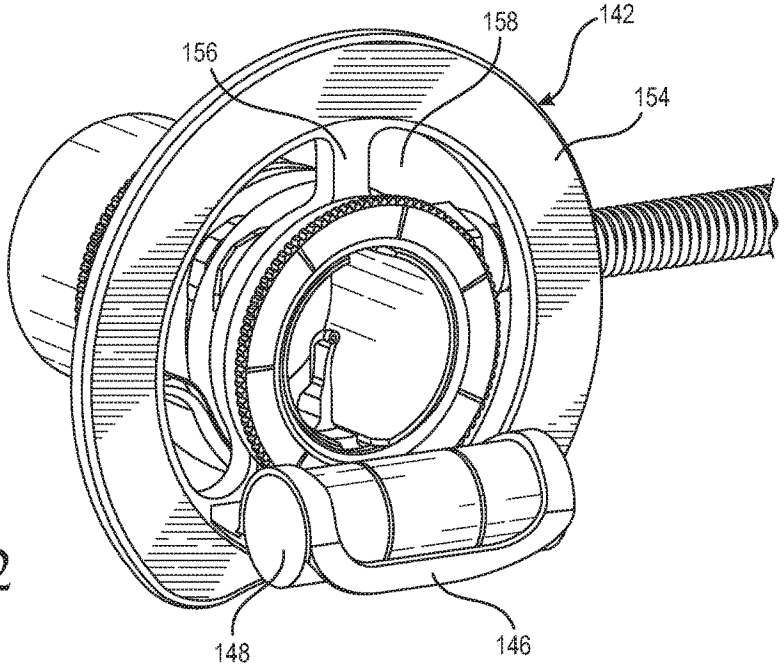
FIG. 12 is a perspective view of the bow sight of FIG. 10 in an assembled condition.

An alternate configuration for the level assembly 142 is shown in FIGS. 11 and 12. As in the embodiment in FIG. 10, the level assembly includes a ring portion 144 including projections 150 and a receptacle 146 for a bubble-type level indicator 148. However, the level assembly 142 further includes a peep alignment ring 152 which extends radially outwardly from the ring portion 144 beyond an outer circumference of the sight housing as shown in FIG. 12. The peep alignment ring contains an annular surface 154 which extends at least partially around the circumference of the ring. The annular surface is spaced from the inner ring portion 144 by connector portions 156 which define openings 158 between the peep alignment ring and the inner ring portion. Collectively, the annular surface, the openings, 158, the housing, and the sight pin provide a visual perspective to the archer for superior accuracy when aiming the bow at a target.

The housing components of the bow sight are preferably made of a durable light-weight material such as synthetic plastic. They may be painted in different colors to improve the appearance of the sight.

While the preferred forms and embodiments of the invention have been illustrated and described, it will become apparent to those of ordinary skill in the art that various changes and modifications may be made without deviating from the inventive concepts set forth above.

What is claimed is:

1. A bow sight, comprising (a) a cylindrical housing having a first end;

(b) a ring pin assembly removably mounted on said housing first end and including a ring pin external of said housing and visible within said housing.

2. A bow sight as defined in claim 1, and further comprising a ring pin retainer connected with said housing first end to retain said ring pin on said housing.

3. A bow sight as defined in claim 1, wherein said housing first end contains at least one slot extending parallel with an axis of said housing and said ring pin assembly includes a projection configured to mate with said housing slot, thereby to prevent said ring pin assembly from rotating relative to said housing.

4. A bow sight as defined in claim 3, wherein said housing is reversible to accommodate right and left handed archers.

5. A bow sight as defined in claim 3, wherein said housing includes a second end opposite said first end and further comprising a lens arranged within said housing second end and a lens retainer connected with said housing second end to retain said lens within said housing.

6. A bow sight as defined in claim 3, wherein said ring pin assembly includes an optical fiber arranged on an external surface of said ring pin assembly to illuminate said ring pin.

7. A bow sight, comprising (a) a cylindrical housing having a first end;

(b) a ring pin assembly removably mounted on said housing first end and including a ring pin visible within said housing and an optical fiber arranged on an external surface of said ring pin assembly to illuminate said ring pin; and (c) an annular cover assembly including an arcuate portion extending over at least a portion of said ring pin assembly external surface, said annular cover assembly being rotatable relative to said ring pin assembly to control the amount of said optical fiber which is exposed to ambient light.

8. A bow sight as defined in claim 7, and further comprising a level assembly mounted on said housing.

9. A bow sight as defined in claim 8, wherein said level assembly includes an annular ring arranged between said sight pin assembly and said ring pin retainer.

10. A bow sight as defined in claim 9, wherein said level assembly annular ring contains at least one projection configured to mate with said housing slot, thereby to prevent said level assembly from rotating relative to said housing.

11. A bow sight as defined in claim 9, wherein said housing first end contains at least one pair of slots arranged opposite one another, said ring pin assembly and said level assembly including two projections for mating with said slots of said pair of slots, respectively.

12. A bow sight as defined in claim 9, wherein said level assembly annular ring includes a peep alignment ring which extends radially outwardly beyond an outer circumference of said housing.

13. A bow sight as defined in claim 12, wherein said peep alignment ring contains an annular surface extending at least partially around a circumference of said ring.

14. A bow sight as defined in claim 13, wherein said alignment ring contains openings between a central portion of said ring which is mounted on said housing and said annular surface, said alignment ring providing a visual perspective to the archer for superior accuracy when aiming a bow at a target.

* * * * *